US008082104B2

(12) United States Patent
de Reynal

(10) Patent No.: US 8,082,104 B2
(45) Date of Patent: Dec. 20, 2011

(54) METHOD TO DETERMINE ROCK PROPERTIES FROM DRILLING LOGS

(75) Inventor: Michel de Reynal, Arthez de Bearn (FR)

(73) Assignee: Varel International Ind., L.P., Carrollton, TX (US)

( * ) Notice: Subject to any disclaimer, the term of this patent is extended or adjusted under 35 U.S.C. 154(b) by 442 days.

(21) Appl. No.: 12/359,065

(22) Filed: Jan. 23, 2009

(65) Prior Publication Data

US 2010/0191471 A1 Jul. 29, 2010

(51) Int. Cl.
*G01V 1/40* (2006.01)
*G01V 3/18* (2006.01)

(52) U.S. Cl. ..... 702/9; 702/11

(58) Field of Classification Search ..... 702/9, 11, 702/6; 703/7, 10; 175/39, 40, 54, 57, 65, 175/66, 67; 73/152.02, 152.03, 152.11, 152.22
See application file for complete search history.

(56) References Cited

U.S. PATENT DOCUMENTS

| | | | | |
|---|---|---|---|---|
| 4,794,534 | A | 12/1988 | Millheim | 702/9 |
| 4,845,628 | A * | 7/1989 | Gray et al. | 702/9 |
| 4,914,591 | A | 4/1990 | Warren et al. | 702/9 |
| 5,415,030 | A | 5/1995 | Jogi et al. | 73/152.03 |
| 5,704,436 | A | 1/1998 | Smith et al. | 175/27 |
| 5,767,399 | A | 6/1998 | Smith et al. | 73/152.11 |
| 5,794,720 | A | 8/1998 | Smith et al. | 175/40 |
| 6,044,327 | A | 3/2000 | Goldman | 702/11 |
| 6,052,649 | A | 4/2000 | Goldman et al. | 702/11 |
| 6,109,368 | A | 8/2000 | Goldman et al. | 175/39 |
| 6,131,673 | A | 10/2000 | Goldman et al. | 175/40 |
| 6,349,595 | B1 | 2/2002 | Civolani et al. | 73/152.02 |
| 6,374,926 | B1 | 4/2002 | Goldman et al. | 175/39 |
| 6,386,297 | B1 | 5/2002 | Cooley et al. | 175/39 |
| 6,408,953 | B1 | 6/2002 | Goldman et al. | 175/39 |
| 6,424,919 | B1 | 7/2002 | Moran et al. | 702/6 |
| 6,516,293 | B1 | 2/2003 | Huang et al. | 703/10 |
| 6,612,382 | B2 | 9/2003 | King | 175/40 |
| 6,695,073 | B2 | 2/2004 | Glass et al. | 175/40 |
| 6,785,641 | B1 | 8/2004 | Huang | 703/7 |
| 6,856,949 | B2 | 2/2005 | Singh et al. | 703/7 |
| 6,873,947 | B1 | 3/2005 | Huang et al. | 703/10 |
| 7,020,597 | B2 | 3/2006 | Oliver et al. | 703/7 |
| 7,032,689 | B2 | 4/2006 | Goldman et al. | 175/39 |
| 7,035,778 | B2 | 4/2006 | Goldman et al. | 703/10 |

(Continued)

OTHER PUBLICATIONS

A Thesis by Jose Gregoria Salas Safe, *Drilling Optimization Using Drilling Simulator Software*, May 2004, pp. 1-89.

(Continued)

*Primary Examiner* — John H Le
(74) *Attorney, Agent, or Firm* — King & Spalding LLP

(57) ABSTRACT

A method of identifying one or more rock properties and/or one or more abnormalities occurring within a subterranean formation. The method includes obtaining a plurality of drilling parameters, which include at least the rate of penetration, the weight on bit, and the bit revolutions per minute, and then normalizing these plurality of drilling parameters by calculating a depth of cut and an intrinsic drilling impedance. Typically, the intrinsic drilling impedance is specific to the type of bit used to drill the wellbore and includes using a plurality of drill bit constants. From this intrinsic drilling impedance, the porosity and/or the rock strength may be determined which is then compared to the actual values to identify the specific type of the one or more abnormalities occurring. Additionally, the intrinsic drilling impedance may be compared to other logging parameters to also identify the specific type of the one or more abnormalities occurring.

24 Claims, 9 Drawing Sheets

U.S. PATENT DOCUMENTS

| | | | | |
|---|---|---|---|---|
| 7,085,696 | B2 | 8/2006 | King | 703/10 |
| 7,139,689 | B2 | 11/2006 | Huang | 703/7 |
| 7,261,167 | B2 | 8/2007 | Goldman et al. | 175/39 |
| 7,357,196 | B2 | 4/2008 | Goldman et al. | 175/24 |
| 2005/0267719 | A1 | 12/2005 | Foucault | 703/10 |
| 2006/0149478 | A1 * | 7/2006 | Calhoun et al. | 702/9 |

OTHER PUBLICATIONS

Jeanne M. Perdue, *Technologies Used for Drill Bit Design*, Upstream CIO, Dec. 2005, pp. 1-3, Zeus Development Corporation, *Reprinted for Varel International with permission from Upstream CIO Newsletter*.

E. Bjornsson, B. Hucik, G. Szutiak, L.A. Brown Jr., H. Evans, D. Curry and P. Perry, *Drilling Optimization Using Bit Selection Expert System ROP Prediction Algorithm Improves Drilling Performance and Enhances Operational Decision Making by Reducing Performance Uncertainties*, SPE International, SPE 90752, Sep. 2004, pp. 1-6, Society of Petroleum Engineers Inc.

Jim O'Hare and Osarumwense O.A. Aigbekaen Jr., *Design Index: A Systematic Method of PCD Drill-Bit Selection*, International Association of Drilling Contractors and SPE International Society of Petroleum Engineers, IADC/SPE 59112, Feb. 2000, pp. 1-15, IADC/SPE Drilling Conference.

R.K. Bratli, G. Hareland, F. Stene, G. W. Dunsaed and G. Gjelstad, *Drilling Optimization Software Verified in the North Sea*, SPE International Society of Petroleum Engineers, SPE 39007, Aug. 1997, pp. 1-7, Society of Petroleum Engineers, Inc.

* cited by examiner

METHOD TO DETERMINE ROCK PROPERTIES FROM DRILLING LOGS

BACKGROUND OF THE INVENTION

This invention relates generally to a method of determining rock properties and, more particularly, to a method that utilizes a mathematical model of a drill bit to determine the rock properties.

Identifying rock properties is key for the drilling industry and can potentially provide substantial economic benefits if performed properly and timely. Typically, rock properties are determined in the drilling industry by the use of two main methods. One of the main methods is core sampling testing, while the other main method is wireline log interpretation.

Core sampling testing is the most accurate of the two methods because the measurements are done on real rock. However, as is well known in the industry, this method is very expensive and time consuming; thereby, making it unfeasible to core the entire well. Hence, the data obtained does not provide a continuum of rock properties throughout the depth of the well. As a result, many potential economic benefits remain unrealized, such as the identification of depleted zones that are capable of producing gas. Additionally, due to the limits inherent to coring, partial or total losses of core material can occur due to jamming, failure of the core catcher, and crumbling of loose sections.

In the second alternative method, wireline logs provide measurement readings of gamma ray, sonic, resistivity, neutron, photoelectric, and density. These wireline logs are computed using specific software programs to determine firstly the type of rocks and then using special algorithms to determine the rock properties. Typically, the rock properties are identified through engineering analysis well after the well has been drilled and the drilling equipment has been disassembled. From these wireline logs, potential abnormalities may be identified, including but not limited to, overbalanced conditions, bit balling or dulling, stabilizer or BHA hang-up, stress on borehole, inadequate bit selection, hard rock, and depleted zones. However, the current methods are not capable of identifying precisely which abnormality is occurring. Additionally, the identification of potential depleted zones that are capable of producing gas are typically delayed until after all the drilling equipment has been disassembled and moved on to the next well. Once the drilling equipment has been disassembled and moved on, it is oftentimes too costly to bring the drilling equipment back to the well. Moreover, since it is not possible to precisely identify which abnormality is occurring during the well drilling, oftentimes, the drill bit may be prematurely removed from the well, which results in costly downtime.

According to some known methods, one such rock property that is measured is the rock strength, which is measured by its compressive strength. The knowledge of the rock strength has been found to be important in the proper selection and operation of drilling equipment. For example, the rock strength, for the most part, determines what type of drill bit to utilize and what weight on bit ("WOB") and rotational speeds ("RPM") to utilize. Rock strength may be estimated from wireline log readings using various mathematical modeling techniques. FIG. 1 shows a graph illustrating the rock properties, more particularly the unconfined compressive strength ("UCS") of the rock, which may be read directly from sonic travel time wireline log readings. According to FIG. 1, the rock strength is inversely proportional to the sonic travel time. Thus, as the rock strength decreases, the sonic travel time increases.

FIG. 2 shows a graph illustrating the rock properties, more particularly the unconfined compressive strength of the rock, which may be read using porosity values estimated from the interpretation of the wireline logs. As seen in FIG. 2, the effective porosity—UCS relationship is roughly exponential with slight differences occurring between rocks other than sandstone. According to FIG. 2, the rock strength is inversely proportional to the effective porosity. Thus, as the rock strength decreases, the effective porosity increases. Sonic and/or acoustic impedance have even a better curve fit; however, account must again be taken for sandstone. Sandstone is known to be very light for its strength, thereby causing inaccurate interpretation of the wireline logs at times.

As known to those of ordinary skill in the art, softer rock should always be drilled at a higher rate of penetration ("ROP") when utilizing the same drilling parameters. However, due to the rock properties of certain rocks, current methods in determining the rock strength do not provide accurate information in discerning the actual type of rock. For example, with sandstone having an acoustic impedance value of 14, it is almost impossible to drill with a medium grade bit. However, with the same acoustic impedance value for shale or carbonates, it is possible to drill with a polycrystalline diamond cutter ("PDC") bit.

In view of the foregoing discussion, need is apparent in the art for improving methods for more accurately identifying rock properties. Further, need is apparent in the art for improving methods for more accurately identifying rock porosity. Additionally, a need is apparent for properly identifying potential abnormalities while drilling. Further, a need is apparent for properly identifying depleted zones while drilling. Furthermore, a need is apparent for properly identifying hard rock while drilling. Moreover, a need is apparent for properly identifying problems associated with the bit and other drilling tools while drilling. A technology addressing one or more such needs, or some other related shortcoming in the field, would benefit down hole drilling, for example identifying depleted zones while drilling and/or creating boreholes more effectively and more profitably. This technology is included within the current invention.

BRIEF DESCRIPTION OF THE DRAWINGS

The foregoing and other features and aspects of the invention will be best understood with reference to the following description of certain exemplary embodiments of the invention, when read in conjunction with the accompanying drawings, wherein.

DETAILED DESCRIPTION OF THE INVENTION

The present invention relates generally to a method of determining rock properties and, more particularly, to a method that utilizes a mathematical model of a drill bit to determine the rock properties. Some of the rock properties that may be determined include, but is not limited to, rock compressive strength, confined and unconfined, and rock porosity. These properties are determined at real-time or at near real-time so that appropriate drilling modifications may be made while drilling, for example, replacing the drill bit due to cutter damage, or so that perforations may be made in the well within the identified depleted zones prior to disassembling the drilling equipment. As described below, certain operating characteristics of a drill bit, or bit design constants, may be utilized in the present method along with the operational parameters, which include, but is not limited to, rate of penetration ("ROP"), weight on bit ("WOB"), and bit revolution per minute ("RPM"). These operational parameters may be recorded and are depth correlated so that each operational parameter is provided at the same given depths. These parameters are easily obtained in analog or digital form while drilling, as is well known in the art, from sensors on the drill rig and can thus be recorded and transmitted in real-time or delayed to a microprocessor that may be utilized in any of the exemplary embodiments. Further, these calculations may be made by persons alone or in combination with a computer. Alternatively, in another exemplary embodiment, the parameters may be obtained from the drill bit if designed to be very sensitive to the rock strength or to the drilling impedance. Thus, this alternative exemplary embodiment allows the drill bit to effectively become a tuned component of the logging while drilling system.

Additionally, although exemplary units have been provided for use in the equations below, the units may be converted into alternative corresponding units without departing from the scope and spirit of the exemplary embodiment. For example, although Co may be provided in mega Pascals, Co may be provided in psi without departing from the scope and spirit of the exemplary embodiment.

Figure 3:
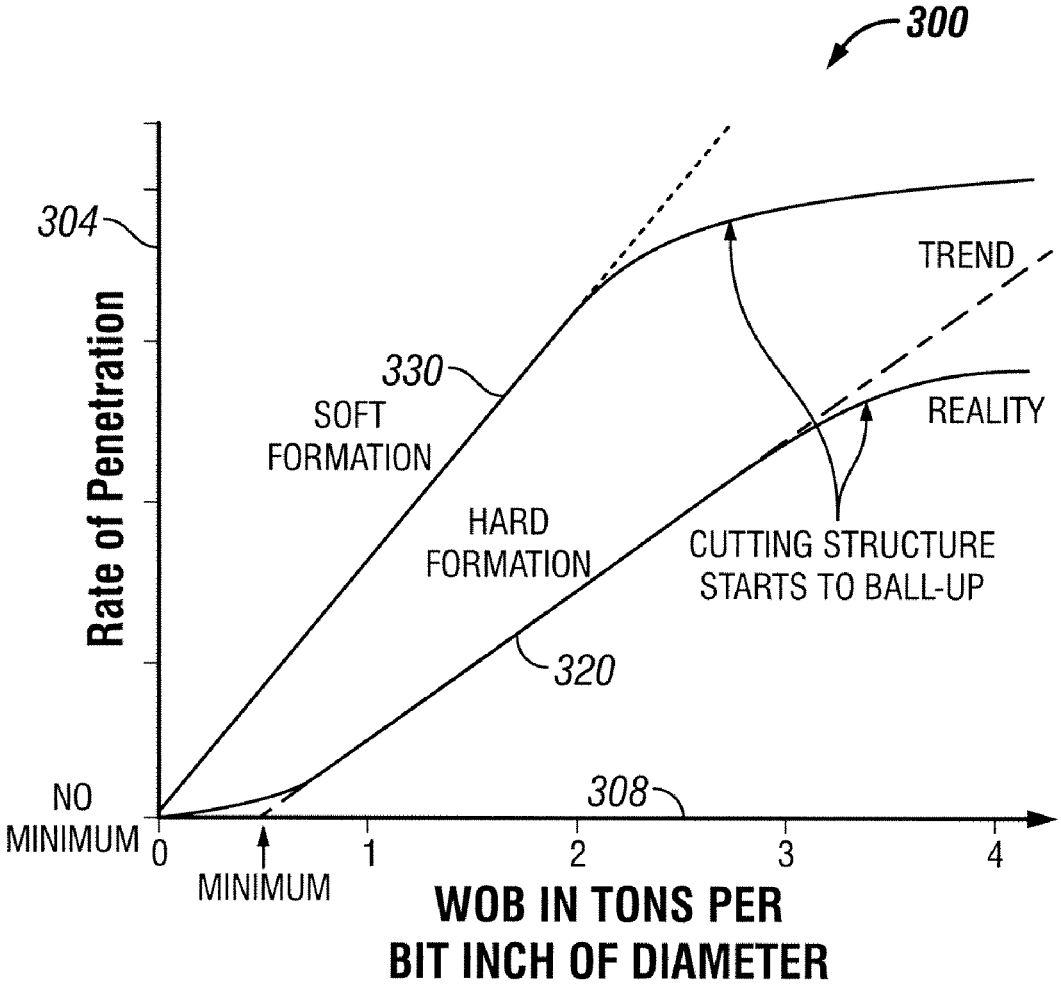
FIG. 3 shows a graph illustrating the relationship between rate of penetration ("ROP") to weight on bit ("WOB") for both hard formations and soft formations, in accordance with an exemplary embodiment.

FIG. 3 shows a graph 300 illustrating the relationship between rate of penetration ("ROP") 304 to weight on bit ("WOB") 308 for both hard formations 320 and soft formations 330, in accordance with an exemplary embodiment. According to FIG. 3, it can be seen that the ROP 304, for both hard formations 320 and soft formations 330, is related to the WOB 308 almost linearly past a threshold value depending on the rock strength, which is the minimal stress required to fail the rock formation, and within a reasonable window of WOB 308 values. For the soft formation 330, there is a negligible threshold value and the reasonable window of WOB 308 values is about 0 tons per bit inch of diameter to about 2 tons per bit inch of diameter. After about 2 tons per bit inch of diameter, the ROP 304 is no longer linear with respect to the WOB 308 and begins tapering to its maximum ROP 304 as additional WOB 308 is applied. For the hard formation 320, the threshold value is about 0.5 tons per bit inch of diameter and the reasonable window of WOB 308 values is about 0.5 tons per bit inch of diameter to about 3.3 tons per bit inch of diameter. After about 3.3 tons per bit inch of diameter, the ROP 304 is no longer linear with respect to the WOB 308 and begins tapering to its maximum ROP 304 as additional WOB 308 is applied. At the point where the ROP 304 is no longer linear with respect to the WOB 308, or at the upper end of the reasonable window of WOB 308 values, the cutting structures on the bit begin to ball up and become damaged. Although two examples of the relationship between ROP 304 and WOB 308 have been shown for hard formations 320 and soft formations 330, alternative formation types may have the same type of relationship as that illustrated for hard formations 320 and soft formations 330 without departing from the scope and spirit of the exemplary embodiment. Also, although approximate values have been provided for the threshold value and the reasonable window of WOB values, other values may be realized for specific formation types without departing from the scope and spirit of the exemplary embodiment. Also seen in FIG. 3 is that the ROP 304 is inversely related to the rock strength. As the rock strength increases, e.g. hard formations 320, the ROP 304 decreases at the same given WOB 308. As the rock strength decreases, e.g. soft formations 330, the ROP increases at the same given WOB 308.

Figure 4:
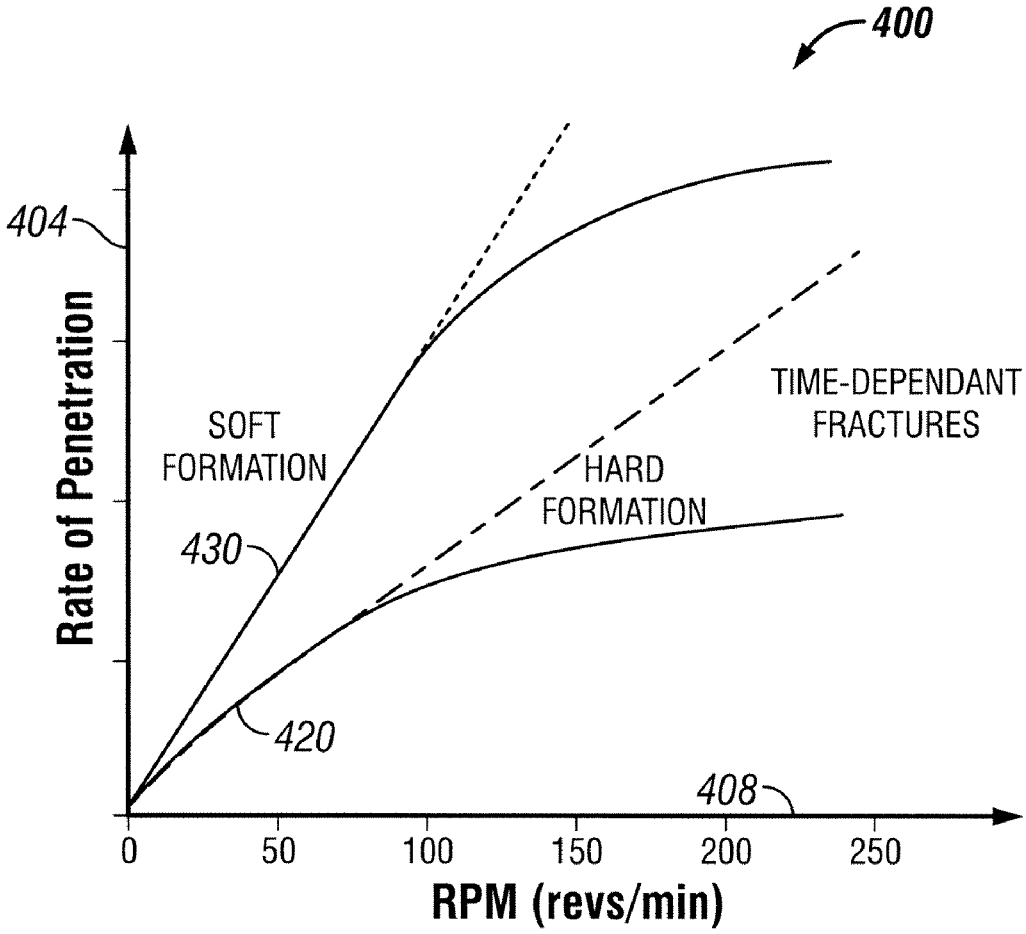
FIG. 4 shows a graph illustrating the relationship between rate of penetration to bit revolutions per minute ("RPM") for both hard formations and soft formations, in accordance with an exemplary embodiment.

FIG. 4 shows a graph 400 illustrating the relationship between rate of penetration 404 to bit revolutions per minute ("RPM") 408 for both hard formations 420 and soft formations 430, in accordance with an exemplary embodiment. According to FIG. 4 and assuming that the WOB is constant where the WOB is above the threshold value, it can be seen that the ROP 404, for both hard formations 420 and soft formations 430, is related to the RPM 408 almost linearly within a reasonable window of RPM 408 values. However, there exists a noticeable difference in the width of the linearity window between the hard formations 420 and the soft formations 430. This noticeable difference is caused because hard rocks found in hard formations 420 need some more time to fail when compared to soft rocks found in soft formations 430. For the soft formation 430, the reasonable window of RPM 408 values is about 0 revolutions per minute to about 90 revolutions per minute. After about 90 revolutions per minute, the ROP 404 is no longer linear with respect to the RPM 408 and begins tapering to its maximum ROP 304 as additional RPM 408 is applied. For the hard formation 420, the reasonable window of RPM 408 values also is about 0 revolutions per minute to about 90 revolutions per minute. After about 90 revolutions per minute, the ROP 404 is no longer linear with respect to the RPM 408 and begins tapering to its maximum ROP 404 as additional RPM 408 is applied. Although two examples of the relationship between ROP 404 and RPM 408 have been shown for hard formations 420 and soft formations 430, alternative formation types may have the same type of relationship as that illustrated for hard formations 420 and soft formations 430 without departing from the scope and spirit of the exemplary embodiment. Also, although approximate values have been provided for the reasonable window of RPM values, other values may be realized for specific formation types without departing from the scope and spirit of the exemplary embodiment.

Figure 1:
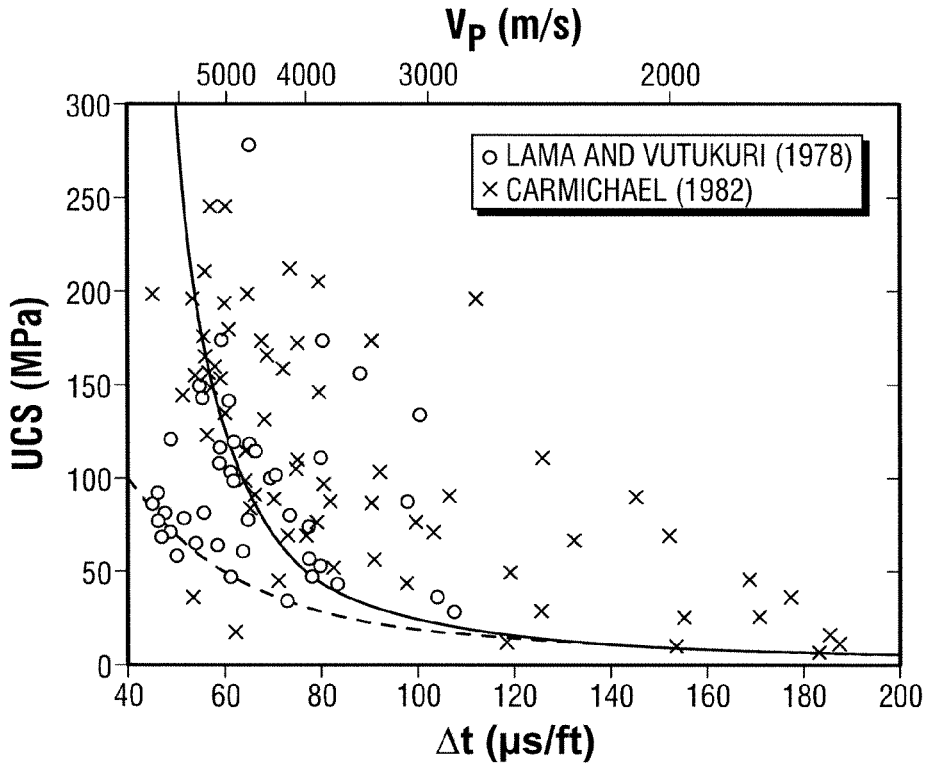
FIG. 1 shows a graph illustrating the rock properties, more particularly the unconfined compressive strength ("UCS") of the rock, which may be read directly from sonic travel time wireline log readings.
Figure 2:
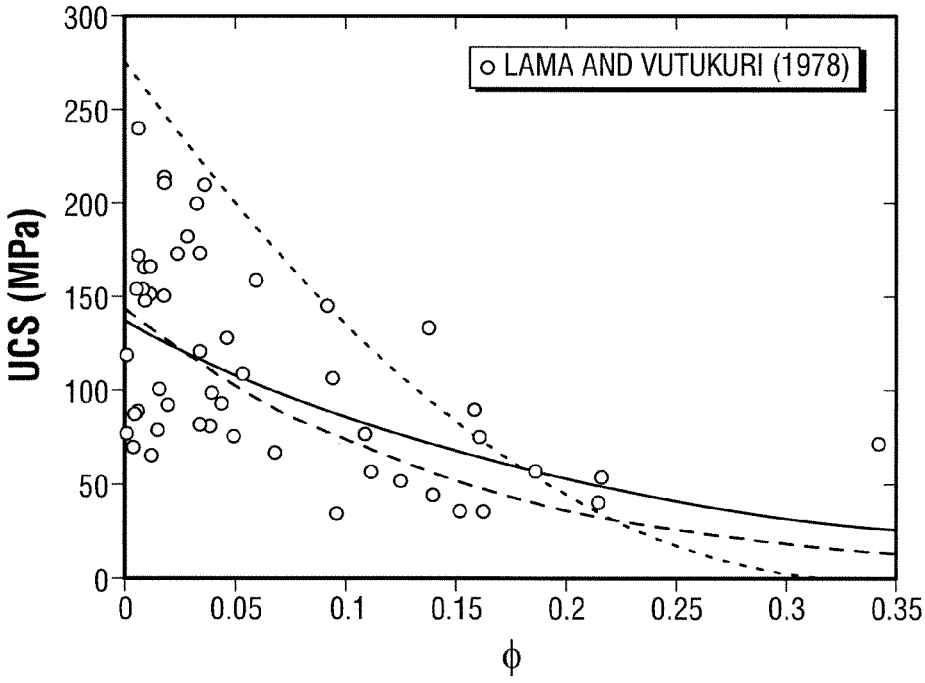
FIG. 2 shows a graph illustrating the rock properties, more particularly the unconfined compressive strength of the rock, which may be read using porosity values estimated from the interpretation of the wireline logs.

Based upon the relationships illustrated in both FIG. 1 and FIG. 2, it may be seen that rock strength cannot be inferred directly from ROP because the ROP has been shown to be different based upon the type of formation. Thus, for drilling parameters to be useful in determining rock strength and/or rock porosity, a transitional step should be used to properly normalize these drilling parameters.

The transitional step includes first determining the apparent depth of cut per revolution of the drilling bit ("DOC"). To determine the DOC, the RPM for a given ROP should be known. The apparent depth of cut may be calculated using the following equation:

$$DOC=ROP/RPM \quad (1)$$

where,
DOC is in millimeters (mm);
ROP is in millimeters/minute (mm/min); and
RPM is in revolutions/minute (rev/min)

The above DOC equation normalizes the ROP and RPM prior to being used in determining the rock porosity and/or the rock strength.

Upon determining the DOC, the drilling impedance ("DRIMP") is determined to normalize the weight on bit ("WOB"). The DRIMP value summarizes the axial force needed to impose a 1 mm depth of cut to the bit. The general equation for DRIMP is:

$$DRIMP=WOB/DOC \quad (2)$$

where,
DRIMP is in tons/millimeters (tons/mm);
WOB is in tons; and
DOC is in millimeters (mm)

Thus, the DRIMP equation normalizes the WOB, the ROP, and the RPM through use of the DOC value. The WOB, the ROP, and the RPM are considered to be factual values. Hence, the DRIMP value is also a factual value. As seen in the DRIMP equation, the torque supplied by the bit does not factor into the equation and thus does not contribute to the determination of the DRIMP value. Torque is not considered to be a factual value; but instead, torque has some interpretation included within its value.

Although the DRIMP value provides a summary of the axial force needed to impose a 1 mm depth of cut to the bit, this DRIMP value is not precise because the actual force needed to engage the bit into the formation is not entirely linear. In actuality, the force needed closely relates to the intrinsic geometry of the bit itself. As shown in the equation below, the stress on a formation is defined by:

$$\sigma=WOB/S \quad (3)$$

where,
σ is the stress on the formation;
WOB is in tons; and
S is projected area in meters$^2$ ($m^2$)

S is a function of the DOC, but is more dependent upon the rock strength itself. A harder rock requires more WOB to fail. Through experimentation and analysis, it has been determined that as the DOC doubles, the projected contact area approximately quadruples. Although this relationship provides a simplistic approximation, the relationship between DOC and projected contact area is more complex. Thus, approximately a four times increase in WOB may be required when the DOC doubles just to retain about the same amount of stress on the formation. However, when doubling the DOC, it should be verified that the DOC does not exceed the exposure of the cutting surface of the drill bit. For these reasons, calibrations are needed to further express rock strengths and/or rock porosity from the drilling parameters. These calibrations are based upon how a bit performs in normal versus abnormal conditions. These calibrations may be made through post-mortem well studies for that particular drill bit, by performing drill test benches on known rocks at variable parameters and sampling rates in excess of about 800 hertz, or by SPOT™ simulation through a section.

Once the drill bit has been properly calibrated, which methods are known to those of ordinary skill in the art, an intrinsic drilling impedance ("IDI") is obtained, which is related to a particular bit type. The equation for IDI is:

$$IDI=WOB^A/DOC^B \text{ or} \quad (4)$$

$$IDI=WOB^A*RPM^B/ROP^C \quad (5)$$

where,
IDI is in tons/millimeters (tons/mm);
WOB is in tons;
DOC is in millimeters (mm);
A is a drill bit design constant;
B is a drill bit design constant; and
C is a drill bit design constant In the instance where the drill bit design constants are unknown, in equation (4), A may be assumed to be 0.5 and B may be assumed to be 1. By taking the square root of the WOB, the occurring noise may be reduced. Although exemplary assumptions have been provided for drill bit constants A and B when the drill bit constants are unknown for equation (4), these assumed values may differ without departing from the scope and spirit of the exemplary embodiment. According to some embodiments, A may have a value ranging between about 0.2 to about 1.0 and B may have a value ranging from about 0.4 to about 1.2.

Once the IDI has been obtained, the IDI may be graphed along with logging parameters, which may include at least the unconfined compressive strength ("UCS") and/or the bulk density ("RHOB"), to determine discrepancies between the logging and drilling parameters. The RHOB is provided in grams per cubic centimeter (g/cc). These discrepancies may help to determine the cause of the abnormalities, which may include, but is not limited to, overbalanced conditions, bit balling or dulling, stabilizer or bottom hole assembly hang-up, stress on the borehole, and inadequate bit selection.

Figure 5:
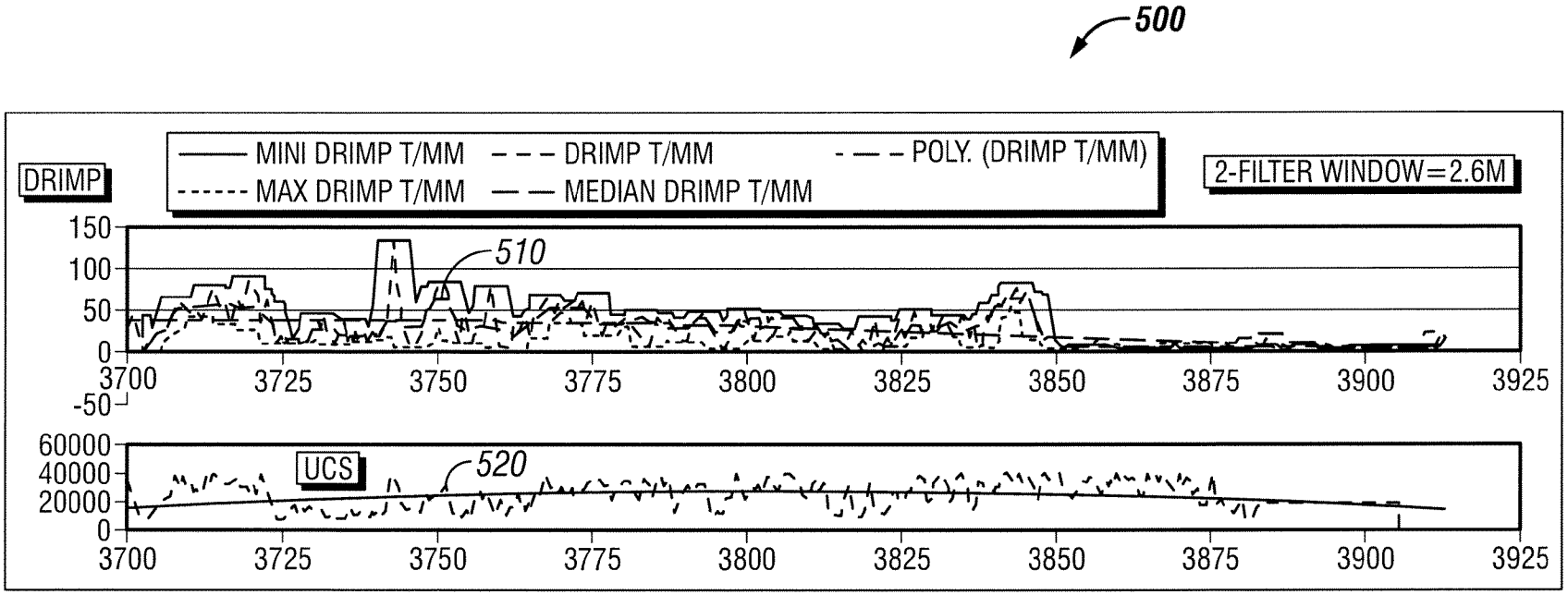
FIG. 5 shows a graph illustrating the comparison between the calculated DRIMP, or IDI, and the unconfined compressive strength estimated from wireline interpretation in accordance with an exemplary embodiment.

FIG. 5 shows a graph 500 illustrating the comparison between the calculated DRIMP, or IDI, 510 and the unconfined compressive strength 520 estimated from wireline interpretation in accordance with an exemplary embodiment. As seen in FIG. 5, the estimated DRIMP 510 corresponds similarly to the unconfined compressive strength 520 estimated from wireline interpretation. For example, the peaks and the valleys of both the estimated DRIMP 510 and the unconfined compressive strength 520 estimated from wireline interpretation are similar at equivalent depths. Additionally, the trends shown in both the estimated DRIMP 510 and the unconfined compressive strength 520 estimated from wireline interpretation are also similar at equivalent depths. However, there may be some abnormalities that are found when graphing DRIMP against the UCS.

Figure 6A:
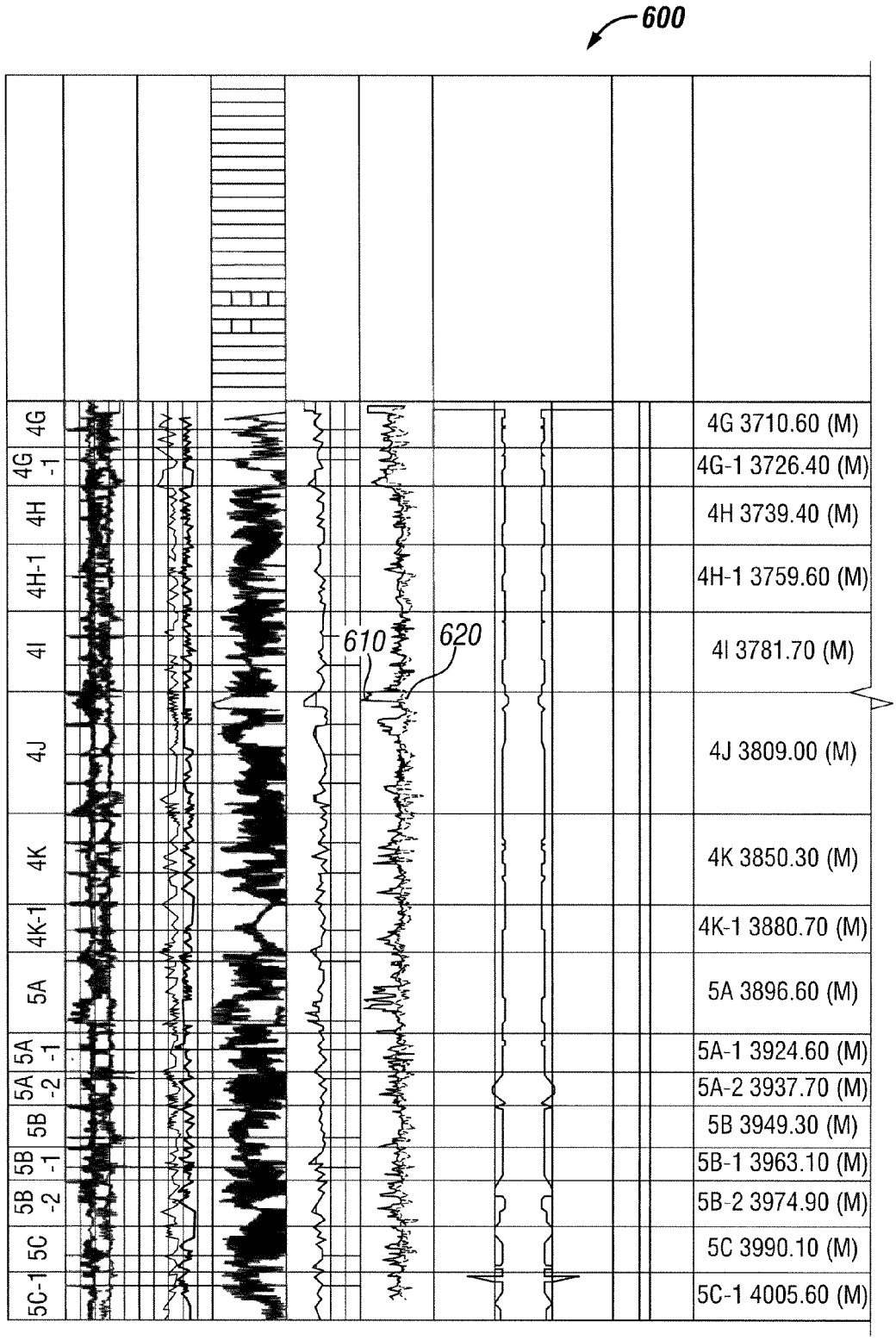
FIG. 6 shows a graph illustrating the comparison between the calculated DRIMP, or IDI, and the unconfined compressive strength estimated from wireline interpretation in accordance with another exemplary embodiment.
Figure 6B:
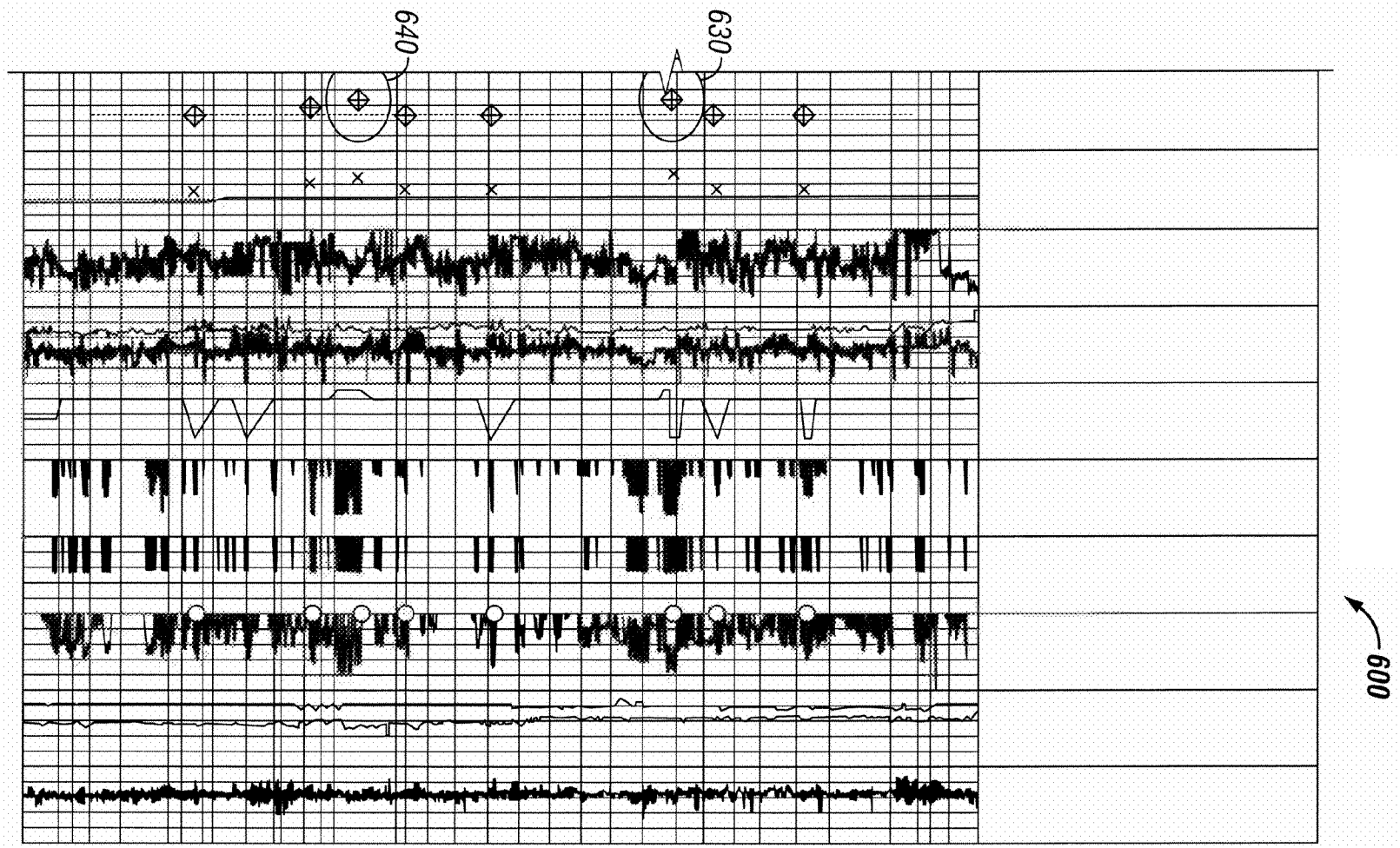

FIG. 6 shows a graph 600 illustrating the comparison between the calculated DRIMP, or IDI, 610 and the unconfined compressive strength 620 estimated from wireline interpretation in accordance with another exemplary embodiment. According to FIG. 6, a first abnormality 630 and a second abnormality 640 are found. An abnormality may be detected when the DRIMP 610 is peaking at the same time that the UCS 620 is showing a valley. Alternatively, an abnormality may be detected when the DRIMP 610 is showing a valley when at the same time the UCS 620 is showing a peak. The particular type of abnormality may be determined by one of ordinary skill in the art viewing the graph 600. According to FIG. 6, the first abnormality 630 and the second abnormality 640 are both high overbalance conditions, which is also suggested by the cake thickness.

Figure 7:
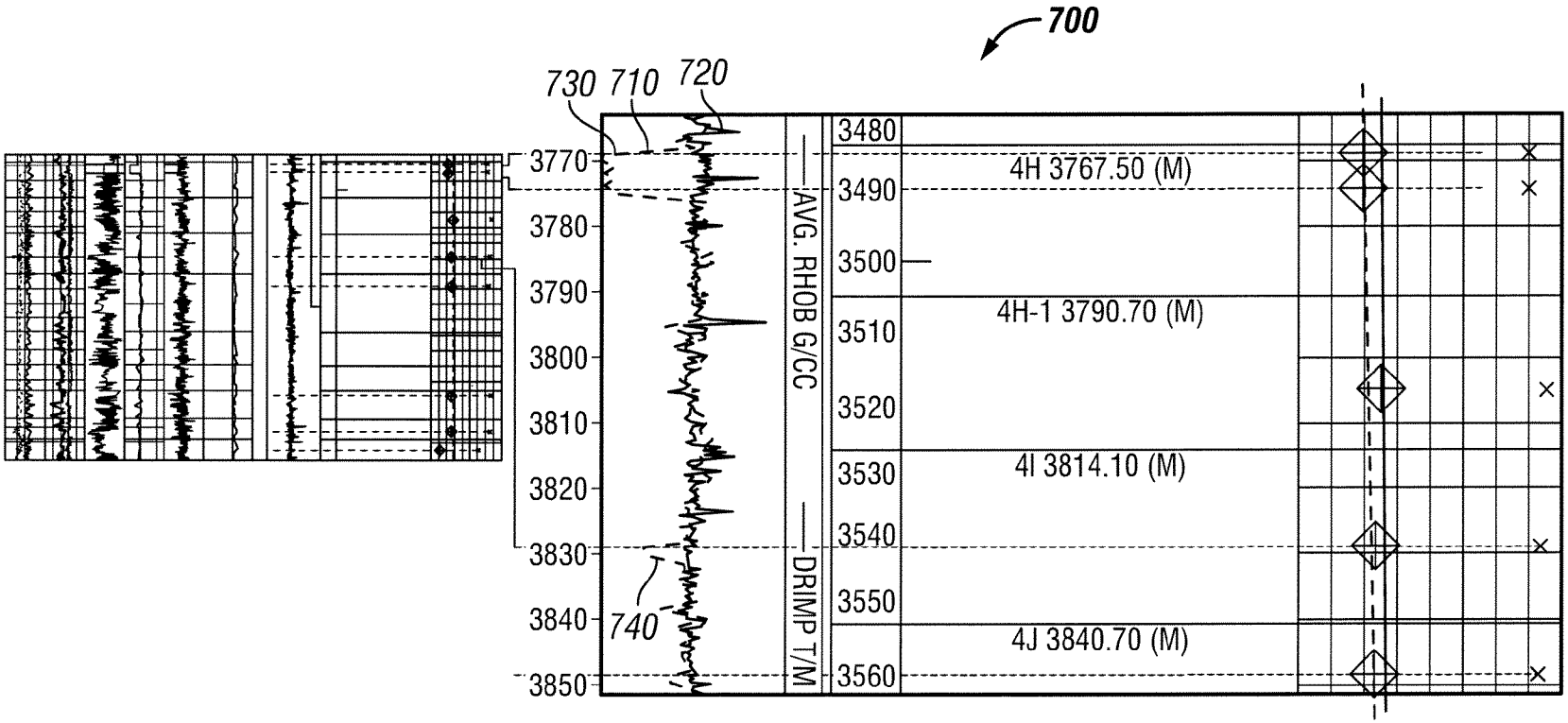
FIG. 7 shows a graph illustrating the comparison between the calculated DRIMP, or IDI, and the bulk density estimated from wireline interpretation in accordance with another exemplary embodiment.

FIG. 7 shows a graph 700 illustrating the comparison between the calculated DRIMP, or IDI, 710 and the bulk density ("RHOB") 720 estimated from wireline interpretation in accordance with another exemplary embodiment. According to FIG. 7, a first abnormality 730 and a second abnormality 740 are illustrated. An abnormality may be detected when the DRIMP 710 is peaking at the same time that the RHOB 720 is showing a valley. Alternatively, an abnormality may be detected when the DRIMP 710 is showing a valley when at the same time the RHOB 720 is showing a peak. The particular type of abnormality may be determined by one of ordinary skill in the art viewing the graph 700. According to FIG. 7, the first abnormality 730 and the second abnormality 740 are both potential depleted zones.

Figure 8:
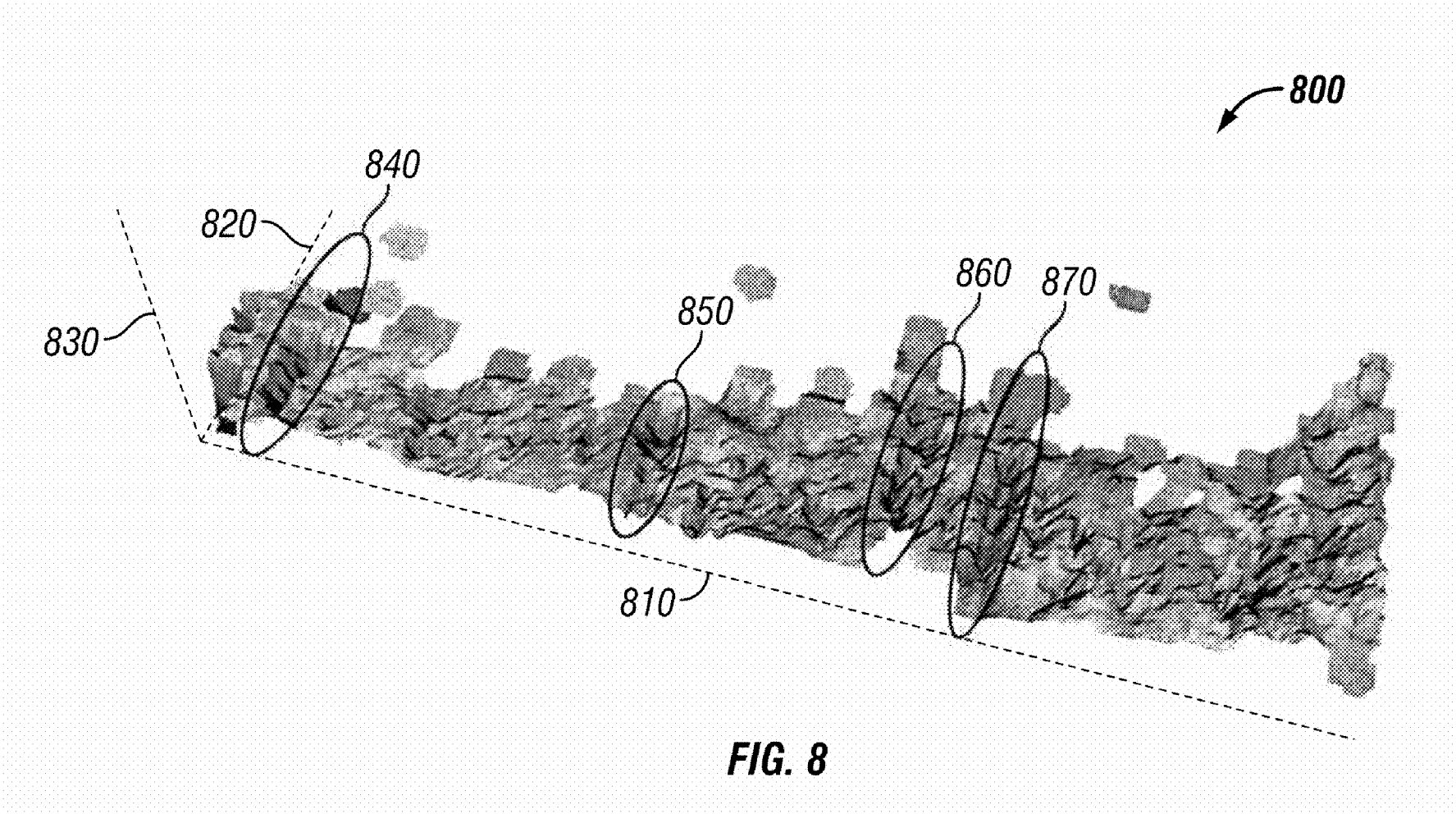
FIG. 8 shows a 3-D graph illustrating the depth on the x-axis, the calculated DRIMP, or IDI, on the y-axis, and the bulk density on the z-axis in accordance with another exemplary embodiment.

FIG. 8 shows a 3-D graph 800 illustrating the depth 810 on the x-axis, the calculated DRIMP, or IDI, 820 on the y-axis, and the RHOB 830 on the z-axis in accordance with another exemplary embodiment. Depleted zones may be detected when there are high DRIMP 820 values in valleys of low RHOB 830. According to FIG. 8, there exists a first depleted zone 840, a second depleted zone 850, a third depleted zone 860, and a fourth depleted zone 870.

Once the IDI is calculated, the cohesion ("Co") may be determined from the IDI knowing the DOC, the WOB, and the RPM. Thus, costly e-logs are avoided or become optional by the current method. The Co may be determined from the following equation:

$$Co = A * IDI^{B} \quad (6)$$

where,

Co is in mega Pascals (MPa);

IDI is in tons/millimeters (tons/mm);

A is a calibration factor depending upon the type of drill bit;

and

B is a calibration factor depending upon the type of drill bit Typically, A may vary from about 5000 to about 30000 and B may be inferior to 1 or equal to 1. These calibration factors may easily be determined by those of ordinary skill in the art. Although an exemplary range has been provided for drill bit calibration factors A and B, these ranges may differ without departing from the scope and spirit of the exemplary embodiment.

Upon determining the Co, the rock strength and/or the rock porosity may be determined. To determine the rock strength, unconfined compressive strength and confined compressive strength, the Co value and the internal friction angle $\phi$ should be known. The internal friction angle $\phi$ may be derived from the lithology of the wellbore. The internal friction angle $\phi$ is determined in a range of 55° for brittle formations, such as sandstones, and 10° for plastic formations, such as shale. It is known that sandstones generally have relatively large internal friction angles $\phi$ when compared to the internal friction angles $\phi$ found in shale and even some limestone and dolomite. Although an exemplary range for internal friction angles $\phi$ have been provided, the range may differ be broader depending upon the type of rock formation without departing from the scope and spirit of the exemplary embodiment.

The unconfined compressive strength ("UCS") may be determined from the following equation:

$$UCS = (2 * Co * \cos\phi)/(1 - \sin\phi) \quad (7)$$

where,

UCS is in mega Pascals (MPa);

Co is in mega Pascals (MPa); and $\phi$ is in degrees (°)

The UCS provides information regarding the rock strength when it is not under confinement.

However, rock found at particular depths is actually reinforced by the pressure difference between the hydrostatic drill fluid pressure at the front of the bit and the pore pressure of the liquids within the formation. This pressure difference is the confining pressure. Hence, the confined compressive strength ("CCS") may be determine by the following equation:

$$CCS = UCS + P_b[(1 + \sin\phi)/(1 - \sin\phi)] \quad (8)$$

where,

CCS is in mega Pascals (MPa);

UCS is in mega Pascals (MPa);

$P_b$ is in mega Pascals (MPa); and $\phi$ is in degrees (°)

The $P_b$ is the confining pressure, which is the overburden pressure plus the hydrostatic pressure.

Figure 9:
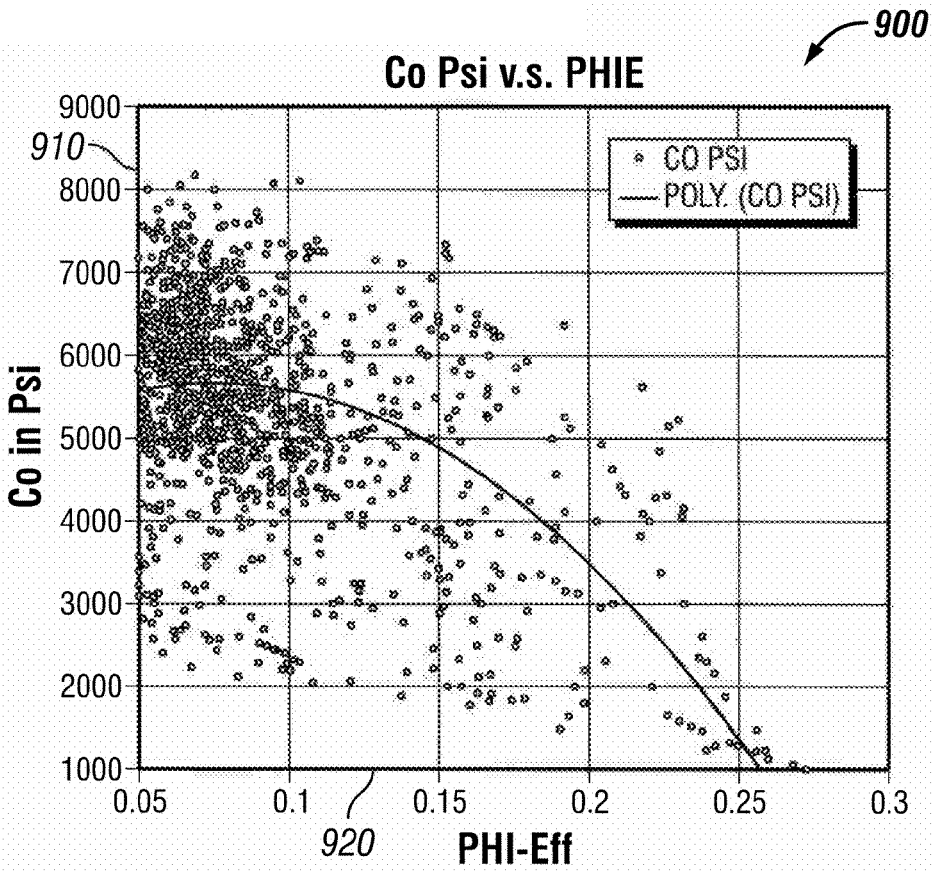
FIG. 9 is a graph illustrating the relationship between cohesion and porosity in accordance with an exemplary embodiment.

In addition to the rock strength, or alternatively, rock porosity (phi-eff) may be determined from the cohesion value obtained from the IDI. FIG. 9 is a graph 900 illustrating the relationship between cohesion 910 and porosity 920 in accordance with an exemplary embodiment. As seen in FIG. 9, the cohesion 910 is generally inversely related to the porosity 920 of the rock structure. As the cohesion 910 increases, the porosity 920 generally decreases. As the cohesion 910 decreases, the porosity 920 generally increases. Depleted zones may also be identified by comparing the calculated, or expected, porosity results to the actual porosity results provided by the wireline logs. In the event that a porous zone is passed during drilling, if the ROP is not increasing within these zones, then the pore pressure is well below the mud weight and more weight is required to maintain the same ROP.

Figure 10:
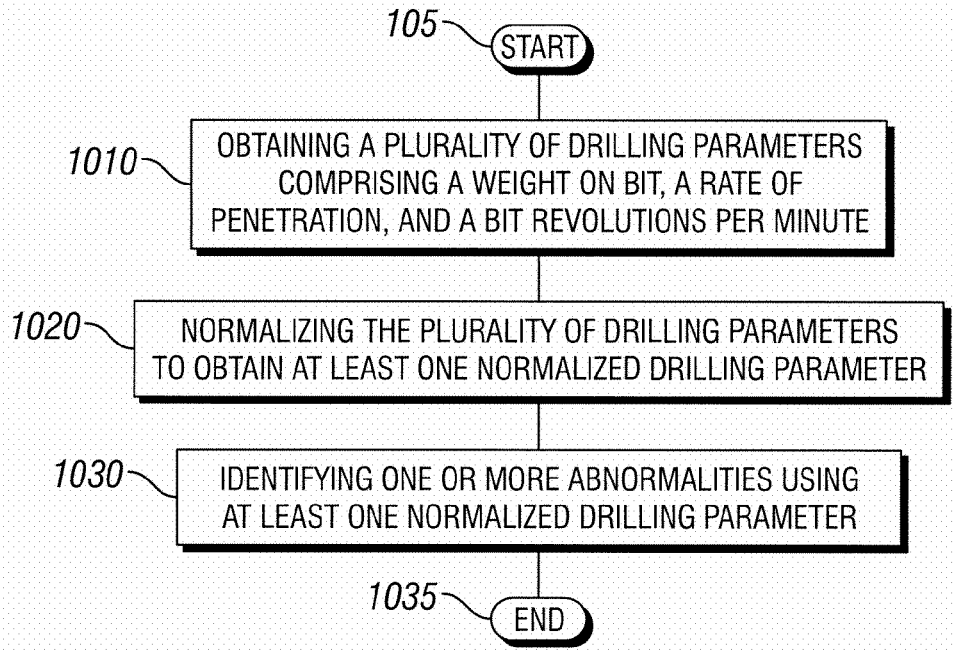
FIG. 10 shows a flowchart illustrating a method for identifying one or more abnormalities occurring within a wellbore in accordance with an exemplary embodiment.

FIG. 10 shows a flowchart illustrating a method 1000 for identifying one or more abnormalities occurring within a wellbore in accordance with an exemplary embodiment. The method 1000 starts at step 1005. Following step 1005, a plurality of drilling parameters comprising weight on bit, rate of penetration, and bit revolutions per minute are obtained at step 1010. These values may be obtained from drilling logs or by other means known to those of ordinary skill in the art. After step 1010, the plurality of drilling parameters are normalized at step 1020. According to some embodiments, these plurality of drilling parameters are normalized by calculating the depth of cut and using the depth of cut to calculate the DRIMP, or IDI. The depth of cut may be calculated by dividing the ROP by the RPM. The DRIMP is calculated by raising the WOB by a first drill bit design constant and dividing it by the DOC raised by a second drill bit design constant. In some embodiments, the first drill bit design constant may be 0.5 and the second drill bit design constant may be 1.0. However, the values of the first drill bit design constant and the second drill bit design constant may be varied without departing from the scope and spirit of the exemplary embodiment. According to some embodiments, A may have a value ranging between about 0.2 to about 1.0 and B may have a value ranging from about 0.4 to about 1.2. After step 1020, one or more abnormalities are identified using the normalized drilling parameters at step 1030. According to some embodiments, the DRIMP, or IDI, may be compared against the UCS, CCS, or the RHOB. According to alternative embodiments, a cohesion value may be calculated to obtain porosity values, which may then be compared to actual porosity values. After step 1030, the method ends at step 1035.

Although the method 1000 has been illustrated in certain steps, some of the steps may be performed in a different order without departing from the scope and spirit of the exemplary embodiment. Additionally, some steps may be combined into a single step or divided into multiple steps without departing from the scope and spirit of the exemplary embodiment.

Typically, a well has between about 120 to about 150 levels. Due to costs, timing, and well integrity, all these levels cannot be perforated, but only some certain desired selected levels may be perforated. The present embodiments assist the operator in determining which levels may provide the best cost benefits and/or production levels for obtaining gas from the depleted zones. According to some embodiments, a depleted zone having thicknesses of at least 0.2 meters may be identified. The thicknesses identified are highly dependent upon the rate of penetration and the equipment used while drilling. According to many embodiments, the identified depleted zone thicknesses may be about 1 meter or greater. These identified thicknesses allow the rate of penetration to be at an acceptable level so that the well may be drilled to total depth within a reasonable acceptable time.

The methods provided by the present embodiments also assist the operator in properly differentiating between hard rock and porous rock, as both require increased WOB to maintain the same ROP. Further, the present methods allow for increased gas extraction from the same well, thereby increasing the profits per well. Additionally, these methods allow for real-time or near real-time determination of the depleted zones so that these zones may be perforated prior to disassembly of the drilling equipment. Furthermore, the methods of the present embodiment provide information so that perforation of zones that may cause problems are avoided. Moreover, depleted zones may be properly identified that could not be discerned from past methods without the use of costly log interpretations.

Although the invention has been described with reference to specific embodiments, these descriptions are not meant to be construed in a limiting sense. Various modifications of the disclosed embodiments, as well as alternative embodiments of the invention will become apparent to persons skilled in the art upon reference to the description of the invention. It should be appreciated by those skilled in the art that the conception and the specific embodiments disclosed may be readily utilized as a basis for modifying or designing other structures and/or methods for carrying out the same purposes of the invention. It should also be realized by those skilled in the art that such equivalent constructions do not depart from the spirit and scope of the invention as set forth in the appended claims. It is therefore, contemplated that the claims will cover any such modifications or embodiments that fall within the scope of the invention.

What is claimed is:

1. A computer implemented method of determining one or more rock properties of a subterranean formation penetrated by a wellbore, comprising:

measuring a plurality of drilling parameters comprising a weight on bit (WOB), a bit revolutions per minute (RPM), and rate of penetration (ROP);

normalizing the plurality of drilling parameters to obtain one or more normalized drilling parameters; and using the normalized drilling parameter to obtain one or more rock properties while drilling, wherein normalizing the plurality of drilling parameters to obtain one or more normalized drilling parameters is performed via at least obtaining a depth of cut (DOC) using the following equation:

$$DOC=ROP/RPM.$$

2. The computer implemented method of claim 1, wherein the one or more rock properties comprises a rock strength.

3. The computer implemented method of claim 2, wherein the rock strength is an unconfined compressive strength.

4. The computer implemented method of claim 2, wherein the rock strength is a confined compressive strength.

5. The computer implemented method of claim 1, wherein the one or more rock properties comprises an effective rock porosity.

6. The computer implemented method of claim 1, wherein normalizing the plurality of drilling parameters to obtain one or more normalized drilling parameters is further performed via obtaining an intrinsic drilling impedance (IDI) using the following equation:

$$IDI=WOB^{A}/DOC^{B}.$$

7. The computer implemented method of claim 6, wherein A ranges from about 0.2 to about 1.0 and B ranges from about 0.4 to about 1.2.

8. The computer implemented method of claim 6, further comprising obtaining a numerical model of a drill bit to be used to drill through the subterranean formation, the numerical model comprising a drill bit design constant A and a drill bit design constant B.

9. The computer implemented method of claim 6, further comprising obtaining a cohesion (Co) using the following equation:

$$Co=A*IDI^{B},$$

wherein A and B are calibration factors dependent upon the a type of drill bit.

10. The computer implemented method of claim 9, wherein A ranges from about 5000 to about 30000.

11. The computer implemented method of claim 9, wherein the one or more rock properties comprises an effective rock porosity, the effective rock porosity being determined from the cohesion.

12. The computer implemented method of claim 9, further comprising obtaining an internal friction angle $\phi$, and wherein the one or more rock properties comprises an unconfined compressive strength (UCS), the UCS being determined from the following equation:

$$UCS=(2*Co*\cos\phi)/(1-\sin\phi).$$

13. The computer implemented method of claim 12, further comprising obtaining a confining pressure $P_b$, and wherein the one or more rock properties comprises a confined compressive strength (CCS), the CCS being determined from the following equation:

$$CCS=UCS+P_b[(1+\sin\phi)/(1-\sin\phi)].$$

14. The computer implemented method of claim 13, wherein the IDI is plotted against the CCS to identify one or more abnormalities within the wellbore.

15. The computer implemented method of claim 14, wherein the one or more abnormalities is at least one of an overbalanced condition, a bit balling, a bit dulling, a stabilizer hang-up, a BHA hang-up, a stress on borehole, an inadequate bit selection, a hard rock, or a depleted zone.

16. The computer implemented method of claim 12, wherein the IDI is plotted against the UCS to identify one or more abnormalities within the wellbore.

17. The computer implemented method of claim 16, wherein the one or more abnormalities is at least one of an overbalanced condition, a bit balling, a bit dulling, a stabilizer hang-up, a BHA hang-up, a stress on borehole, an inadequate bit selection, a hard rock, or a depleted zone.

18. The computer implemented method of claim 6, wherein the plurality of drilling parameters further comprises measuring a bulk density, and wherein the IDI is plotted against the bulk density to identify one or more abnormalities within the wellbore.

19. The computer implemented method of claim 18, wherein the one or more abnormalities is at least one of an overbalanced condition, a bit balling, a bit dulling, a stabilizer hang-up, a BHA hang-up, a stress on borehole, an inadequate bit selection, a hard rock, or a depleted zone.

20. The computer implemented method of claim 18, wherein the IDI is three-dimensionally plotted against the bulk density and a corresponding depth, wherein a depleted zone is identified at the corresponding depth when the IDI is high and the bulk density is in a valley.

21. The computer implemented method of claim 1, further comprising identifying one or more abnormalities from the one or more rock properties.

22. A computer implemented method of identifying one or more abnormalities occurring within a subterranean formation penetrated by a wellbore, comprising:

measuring a plurality of drilling parameters comprising a weight on bit (WOB), a bit revolutions per minute (RPM), and rate of penetration (ROP);

normalizing the plurality of drilling parameters to obtain one or more normalized drilling parameters, the one or more normalized drilling parameters comprising a depth of cut (DOC) and an intrinsic drilling impedance (IDI);

using the normalized drilling parameter to obtain one or more rock properties; and using the one or more rock properties to identify one or more abnormalities occurring within a subterranean formation while drilling, wherein the DOC is determined using the following equation:

$$DOC=ROP/RPM.$$

23. A computer implemented method of identifying one or more abnormalities occurring within a subterranean formation penetrated by a wellbore, comprising:

measuring a plurality of drilling parameters comprising a weight on bit (WOB), a bit revolutions per minute (RPM), and rate of penetration (ROP);

normalizing the plurality of drilling parameters to obtain one or more normalized drilling parameters, the one or more normalized drilling parameters comprising a depth of cut (DOC) and an intrinsic drilling impedance (IDI);

using the normalized drilling parameter to obtain one or more rock properties; and using the one or more rock properties to identify one or more abnormalities occurring within a subterranean formation while drilling, wherein the IDI is determined using the following equation:

$$IDI=WOB^{A}/DOC^{B}.$$

24. A computer implemented method of identifying one or more abnormalities occurring within a subterranean formation penetrated by a wellbore, comprising:

measuring a plurality of drilling parameters comprising a weight on bit (WOB), a bit revolutions per minute (RPM), and rate of penetration (ROP);

normalizing the plurality of drilling parameters to obtain one or more normalized drilling parameters, the one or more normalized drilling parameters comprising a depth of cut (DOC) and an intrinsic drilling impedance (IDI);

using the normalized drilling parameter to obtain one or more rock properties; and using the one or more rock properties to identify one or more abnormalities occurring within a subterranean formation while drilling, wherein the one or more abnormalities is at least one of an overbalanced condition, a bit balling, a bit dulling, a stabilizer hang-up, a BHA hang-up, a stress on borehole, an inadequate bit selection, a hard rock, or a depleted zone.

* * * * *